US005943966A

United States Patent [19]

Machado et al.

[11] Patent Number: 5,943,966

[45] **Date of Patent: *Aug. 31, 1999**

[54] FLEXIBLE FURNITURE SYSTEM WITH ADJUSTABLE AND INTERCHANGEABLE COMPONENTS

[76] Inventors: Jaime U. Machado, 16 Weston Ave., Fishkill, N.Y. 12524; Mikhail L. Marsky, 825 W. 187th St. #3G, New York, N.Y. 10033

[ * ] Notice: This patent issued on a continued prosecution application filed under 37 CFR 1.53(d), and is subject to the twenty year patent term provisions of 35 U.S.C. 154(a)(2).

[21] Appl. No.: 08/911,654

[22] Filed: Aug. 15, 1997

[51] Int. Cl.[6] ..... A47B 57/00

[52] U.S. Cl. ..... 108/64; 248/188.9

[58] Field of Search ..... 108/64, 94, 93, 108/56.01, 100, 197; 248/188.8, 188.9, 188.91

[56] References Cited

U.S. PATENT DOCUMENTS

| | | | |
|---|---|---|---|
| D. 334,483 | 4/1993 | Johnson . | |
| 2,738,246 | 3/1956 | Hogan, Jr. . | |
| 3,002,787 | 10/1961 | Ziegenfuss | 108/64 X |
| 3,338,647 | 8/1967 | Schreyer | 108/64 X |
| 4,154,492 | 5/1979 | Dunning . | |
| 4,223,613 | 9/1980 | Yoshizawa | 108/64 |
| 4,325,597 | 4/1982 | Morrison . | |
| 4,852,500 | 8/1989 | Ryburg et al. | 108/50.01 X |
| 5,038,539 | 8/1991 | Kelley et al. . | |
| 5,078,055 | 1/1992 | Bellni et al. | 108/64 |
| 5,086,597 | 2/1992 | Kelley et al. . | |
| 5,363,772 | 11/1994 | Adamidis . | |
| 5,400,560 | 3/1995 | Hellwig et al. . | |
| 5,428,928 | 7/1995 | Hellwig et al. . | |
| 5,544,593 | 8/1996 | Canfield et al. . | |
| 5,544,594 | 8/1996 | Schairbaum . | |
| 5,704,298 | 1/1998 | Corpuz, Jr. et al. | 108/64 X |

FOREIGN PATENT DOCUMENTS

| | | | |
|---|---|---|---|
| 0168158 | 1/1986 | European Pat. Off. . | |
| 0815775 | 1/1998 | European Pat. Off. . | |
| 1463176 | 12/1966 | France | 108/64 |
| 2323524 | 9/1998 | United Kingdom . | |
| 96/36815 | 11/1996 | WIPO . | |

*Primary Examiner*—Jose V. Chen
*Attorney, Agent, or Firm*—Shenier & O'Connor

[57] ABSTRACT

A furniture system having a countertop midsection, two tower units with gliding base, a rigid screen, and flexible partitions. Using the tower unit shaft's neck, a pivoting connection is used to provide the flexibility of arrangement. The arrangement allows for any angle to be formed between each and every component part of the furniture system without disassembling furniture. A layering design of the tower units allows for multiple configurations. It also allows each component to operate independently of each other. Flexible partitions close the openings between rigid screens and change the configuration along with the system. Furthermore, any component can be upgraded to provide different functions or assume different shapes or forms. An example is the replacement of the shaft by a cage. This allows for a file cabinet inserts or another bulky item to be inserted without eliminating the function of the shaft's neck required to provide the pivoting point for all components. Due to the ease of mobility, the entire system can be easily altered in shape or form by the user at any given time. As a result, the flexibility of the system makes possible the accommodation of any floor plan configuration.

30 Claims, 18 Drawing Sheets

FLEXIBLE FURNITURE SYSTEM WITH ADJUSTABLE AND INTERCHANGEABLE COMPONENTS

BACKGROUND OF THE INVENTION

1. Field of the Invention

This invention relates to the components of a furniture system which specifically improve the flexibility, mobility, and adaptability of the furniture system for its users. The furniture components are interchangeable and adaptable to numerous layouts and configurations. The unique feature of these components is the ability to change an office layout without disassembling the units.

2. The Prior Art

Today's office furniture systems claim to be versatile and flexible, but they are not. All prior concepts in office furniture systems were appropriate for the past when offices and businesses had a steady slow growth rate and were able to expand within the confines of an existing building. Today, however, businesses expand at a much faster pace and to a further extent. Existing office systems cannot accommodate the changing psychology of today's workplace. Today's businesses require quicker on-site solutions for changes that may be necessary on a weekly basis. These changes may require a business to expand within the same floor. Some changes may require an existing space to be reshaped, reconfigured and rearranged using existing furniture components.

Originally furniture systems were inflexible and ill adapted for changing office spaces. Later, furniture companies such as Haworth and SteelCase created a modular office system by creating a partition panel system in which all the components such as the file cabinets, desks, etc., would be attached and dependent upon the layout of the panels. Examples of this are reflected in U.S. Pat. No. 5,038,539 to Herman Miller, Inc.; U.S. Pat. No. 5,544,593 to Rosemount Office Systems, Inc.; U.S. Pat. No. 5,544,594 to Edward C. Schairbaum; U.S. Pat. No. 5,428,928 to John Hellwig; U.S. Pat. No. 4,154,492 to Dunning, Ltd.; U.S. Pat. No. 5,400,560 to Teknion Furniture Systems; U.S. Design Pat. 334,483 to Margaret A. Johnson; and U.S. Pat. No. 5,086,597 to Herman Miller, Inc. These office systems rely heavily on their modular panels to organize floor planning, the wiring of an office space, and a user's workspace. Any configurations would then be limited by the panel systems. The modular panels of those systems increased office layout flexibility during the initial layout. But they became increasingly expensive, limited in scope, and very difficult to rearrange.

Today's open office systems still rely heavily on such panels in an ever-changing office environment. The use of modular panels naturally suffers from a lack of flexibility. After the initial design layout is created, one cannot easily reconfigure component parts or rearrange spaces if a certain area needs to be expanded or adjusted. The ability to change furniture components is predetermined by the use of partition panels. It is difficult to create different size spaces using partition panels. In addition, it is most likely that office spaces are laid out back to back. Since the furniture components are attached and dependent upon the panels, a change of one office area affects another. If the proper panel sizes or components to perform needed changes are not available, new component(s) (panels etc.) would need to be re-ordered making the project more costly. Reorganizing would then produce leftover or unusable parts, which cannot be returned.

The user's area also suffers from the lack of flexibility provided by today's office systems. For example, the office layout may be set up perfectly for the current user, but the next user may find it difficult to adapt to the current setup. This pertains to the so-called one way design, as mentioned before where the initial layout of components is flexible, however, the adaptability to future office environments may be difficult.

Mobility of prior systems is difficult, cumbersome, and not easily adaptable to changes occurring in modern office environments, even if only a move across the floor is required. Mobility on a grander scale is also cumbersome because prior art systems tended to be unmanageable and complex in design. Unmanageable systems are systems that need expert people to disassemble and move the components of large heavy pieces such as panels. Complex systems are systems that have unique detailing and connections not obvious to the user. As doubly noted in U.S. Pat. No. 4,325,597 to Knoll International, Inc., most furniture systems must be taken apart and transported as smaller parts in a flat manner. Even these smaller panels of most systems were 5' (feet) or longer. It is an absolute requirement for these furniture systems to be ultimately emptied of their contents so that parts can be moved to another location.

Finally, since these systems were primarily designed to fit in right angled spaces, these systems fail to adapt to fluid curved wall spaces (which is evident in today's new building and interior design layouts). All so-called flexible furniture systems of today deal with 90 and 180 degree angles. Anything in between would not work and would look awkward. It is evident that the prior art does not solve all of the mentioned problems. Our invention provides solutions to each of these problems. In conclusion, office furniture systems of today tend to be similar to those first introduced many years ago. The prior art of office furniture systems is not flexible enough for today's office environment needs.

In summary, all heretofore known flexible furniture systems suffer from a number of disadvantages:

(a) The prior art of office furniture systems rely heavily on a panel system to organize office areas. This is turn, limits the system from any future changes from its initial configuration.

(b) The prior art does not have the ability to remain flexible for future changes. In addition new layouts are not easily obtained without disturbing more than one office area.

(c) Numerous parts are required to maintain the flexibility of prior art office furniture systems during initial installation. However, due to the increased number of parts (panels, furniture, cabinets, etc.) installation becomes increasingly expensive, and difficult to rearrange the components.

(d) Prior art does not lend itself to adjusting the user's space quickly. Components are dependent upon panels, so wherever the panels fall, components such as desks and cabinets will follow.

(e) The office systems of today and of the past lend themselves to permanence instead of mobility. The office furniture system must be completely disassembled if the office areas were to be moved. It may be concluded that prior art office systems are just another alternative to full height wall partitions of the past.

(f) Prior art deals mostly with 90 and 180 degree angles. Any other angles are not possible using 100% percent of all the components.

SUMMARY OF THE INVENTION

Accordingly, several objects and advantages of the present invention being applied for over prior art systems are:

(a) to provide a system where the furniture components govern and organize the spaces created.

(b) the ability to change into any configuration, because each component is detachable and interchangeable.

(c) to minimize the size of components so as to maintain the ease of mobility of its components and also maintain flexibility after installation.

(d) to enhance the ergonomics of the new system providing adjustability and inter-changeable components for the user. Unlike prior art, this invention is designed to enhance the ergonomic environment of the user.

(e) to provide the ease of mobility without emptying its contents.

(f) to provide the means where every component is allowed to rotate independently creating angled connections other than the standard 90 and 180 degree connections. This in turn allows for greater layout flexibility in unusual spaces such as curved walls and fluid spaces.

Further objectives and advantages are to provide a furniture system where possibilities for add-ons are endless, from placement of computer components within the systems, to providing variations of designs for particular components. For example, the desktop can be ergonomically formed to accommodate a single user or more within a furniture unit. Still further objectives and advantages will become more apparent from a consideration of the ensuing description and drawings.

The unique features of the system are the pivot connection element and the gliding elements. The pivot connection allows the components to swing in any direction making endless rearrangements possible. The gliding element is a simpler and more efficient replacement for standard fixture coasters. It performs a double function as a wheel as well as providing the base for the pivoting unit.

With the computerization of modern offices, large file cabinets and storage units are becoming less and less essential. As a result, our system provides workers with unprecedented ease and mobility to reshape their working environments. It enables them to quickly change their office configurations, install cables, and add elements by themselves without requiring specially trained technicians. The invention is absolutely fluidly adjustable to any configuration and can be adjusted by individual users. In addition, each user can regulate their own degree of privacy in each workspace. This is made possible by flexible, easily adjustable clip-on partitions.

Because this invention does not contain rigid corner connections, it allows for a 25% increased efficiency of space usage.

BRIEF DESCRIPTION OF THE DRAWINGS

In the accompanying drawings to which reference is made in the instant specification which is to be read in conjunction therewith, like reference numerals are used to indicate the parts in the various views. Closely related figures have the same number with different alphabetic suffixes.

DETAILED DESCRIPTION OF PREFERRED EMBODIMENTS

Typical embodiments of systems according to the present invention are illustrated in FIG. 1*a* through FIG. 4. Its parts are shown in detail in FIG. 5*a* to FIG. 11.

Referring now to FIGS. 1*a*, 1*b*, 1*c*, 2*a*, 2*b*, 3 and 4, components of our furniture system may be used to organize any office space. A furniture unit includes a countertop midsection 10-3, and two tower units 10-1 and 10-2 which can be used in any combination. Both towers (10-1 and 10-2) are similar in function except cage tower 10-2 has a swivel cage feature 10K and the other, basic tower 10-1, does not. To further explain the individual parts we shall start with basic tower unit 10-1.

FIGS. 5*a*–5*c* and 6*a*–6*e* all show basic tower unit 10-1 which is the primary unit for our invention and includes a central shaft 10F which is attached to a gliding base 10J, for example by engaging threads 11A with threads 11B. Base 10J also includes a threaded external cylindrical surface 11*c*. This threaded surface 11*c* is used for engaging a locking base ring 10H, which has a corresponding inner cylindrical threaded surface 11D. When rotated downwardly (FIG. 6*e*), locking base ring 10H frictionally engages the floor preventing movement of glider 10J and stabilizing central shaft 10F. Base ring 10H may be annular (FIGS. 5*b*, 5*c*, 6*b* and 8), an apertured disk (FIGS. 6*c*, 6*d* and 6*e*) or disk shaped (FIG. 7*b*). Furthermore, the central base cover 10G is hollow and lowered to cover the locking mechanism.

When the tower unit 10-1 or 10-2 is going to be relocated, base ring 10H is rotated upwardly (FIG. 6*d*) out of engagement with the floor so that glider 10J can glide in any direction. The bottom of glider 10J is a spherical section 11E of large radius. The spherical section provides a reduced surface area for contacting the floor while permitting the base to slide over carpeting or other unevenness in the floor surface. Several, preferably four, bumps or protrusions 11F of relatively small diameter are positioned on the spherical section. These bumps help to stabilize the assembly if it begins to tip over. The gliding base configuration has a relatively low profile, compared to equivalently mobile rollers or casters, making it easier to conceal. In addition, the gliding base may be manufactured from any suitable material, e.g. plastic, making it durable, inexpensive and lightweight.

FIGS. 5*b*, 5*c*, 7*b* and 8 show neck portion 10E at the top of the central shaft 10F. Two collar rings 10D are disposed on the shaft's neck 10F if no add-on attachments are used (explained later). Finally, a circular countertop called a circular cap 10A–10C completes the basic tower.

Figure 1A:
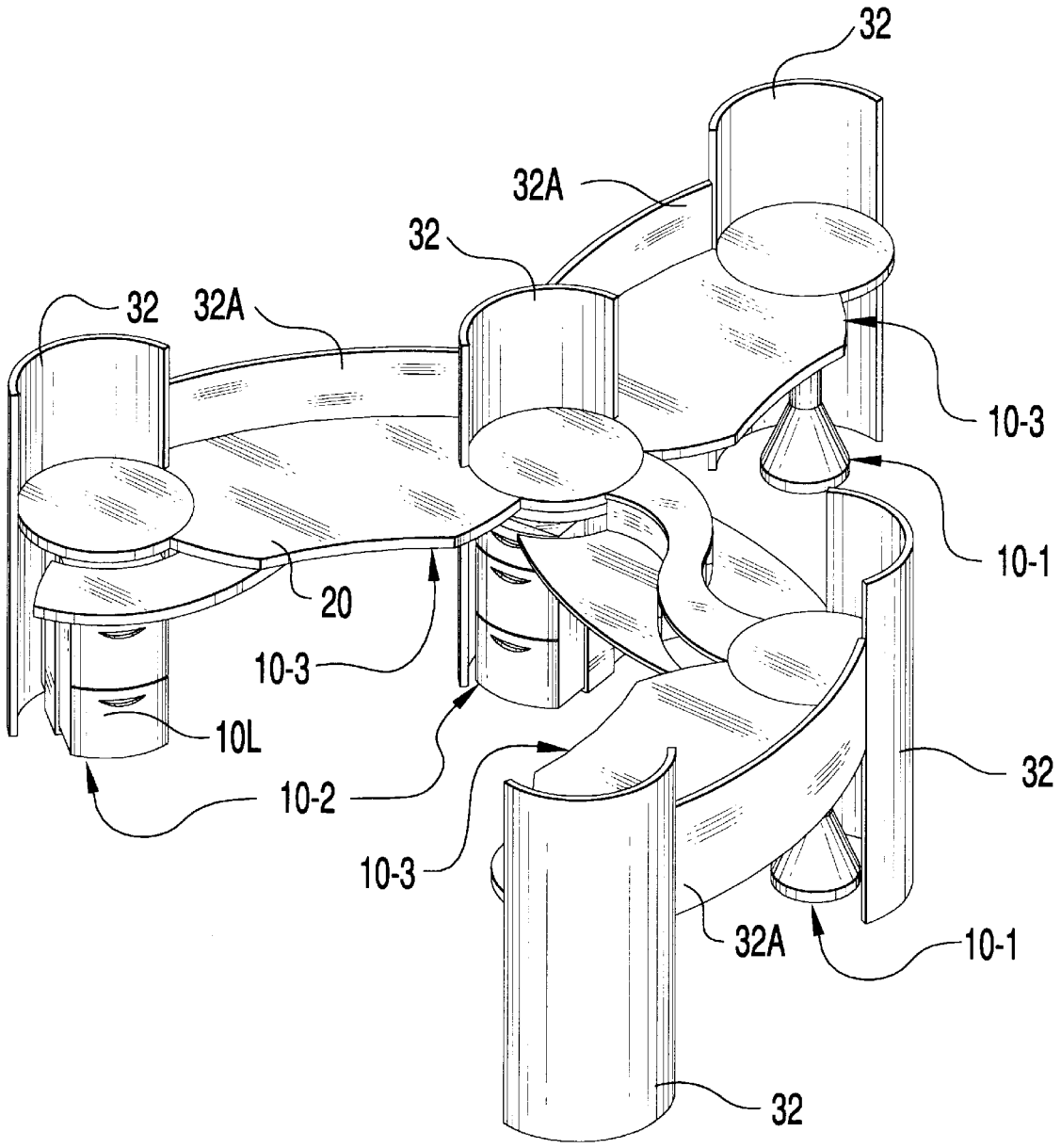
FIG. 1*a* shows how several furniture units and their components can be laid out to form office spaces.
Figure 1B:
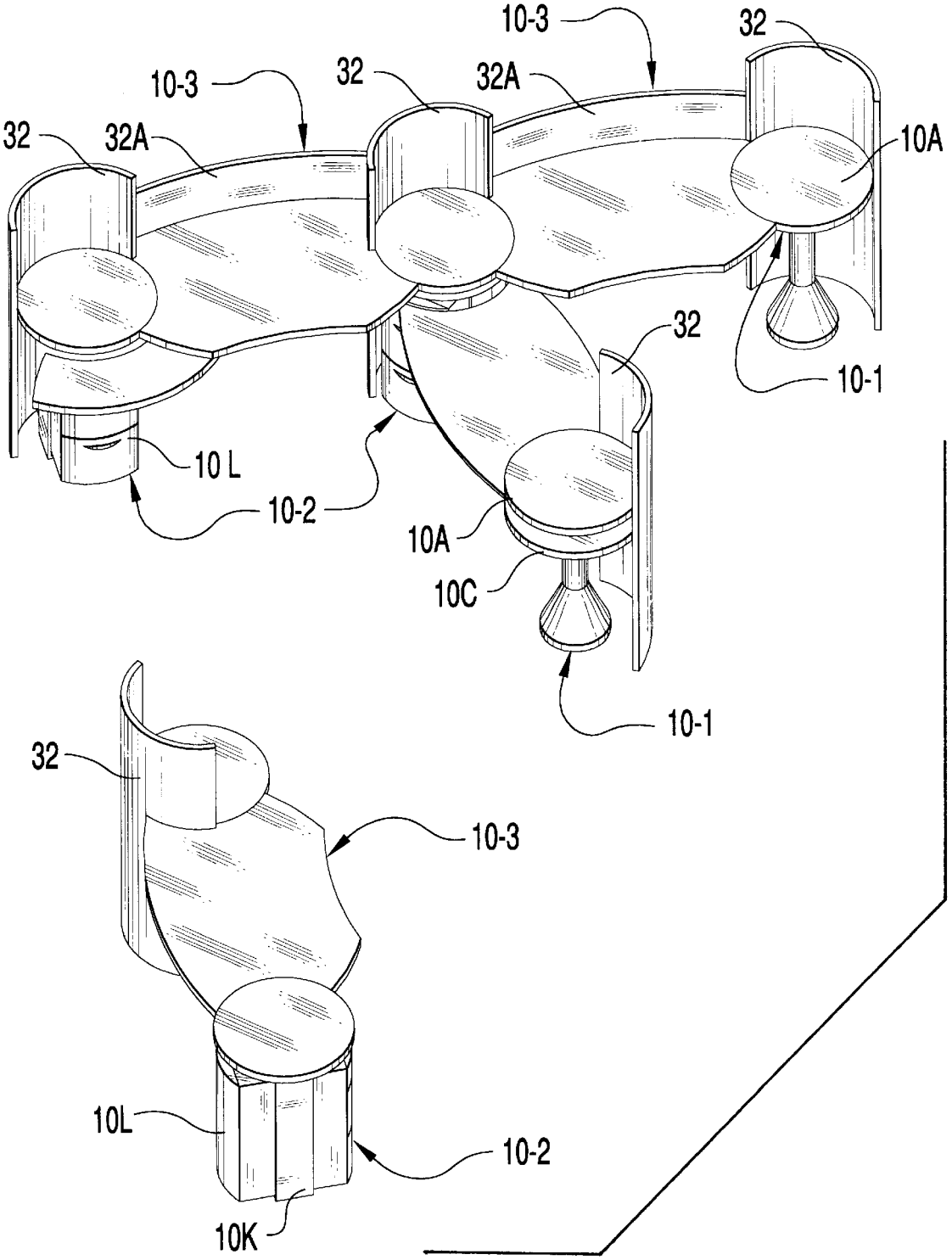
FIG. 1*b* shows the same as FIG. 1*a* with another layout.
Figure 1C:
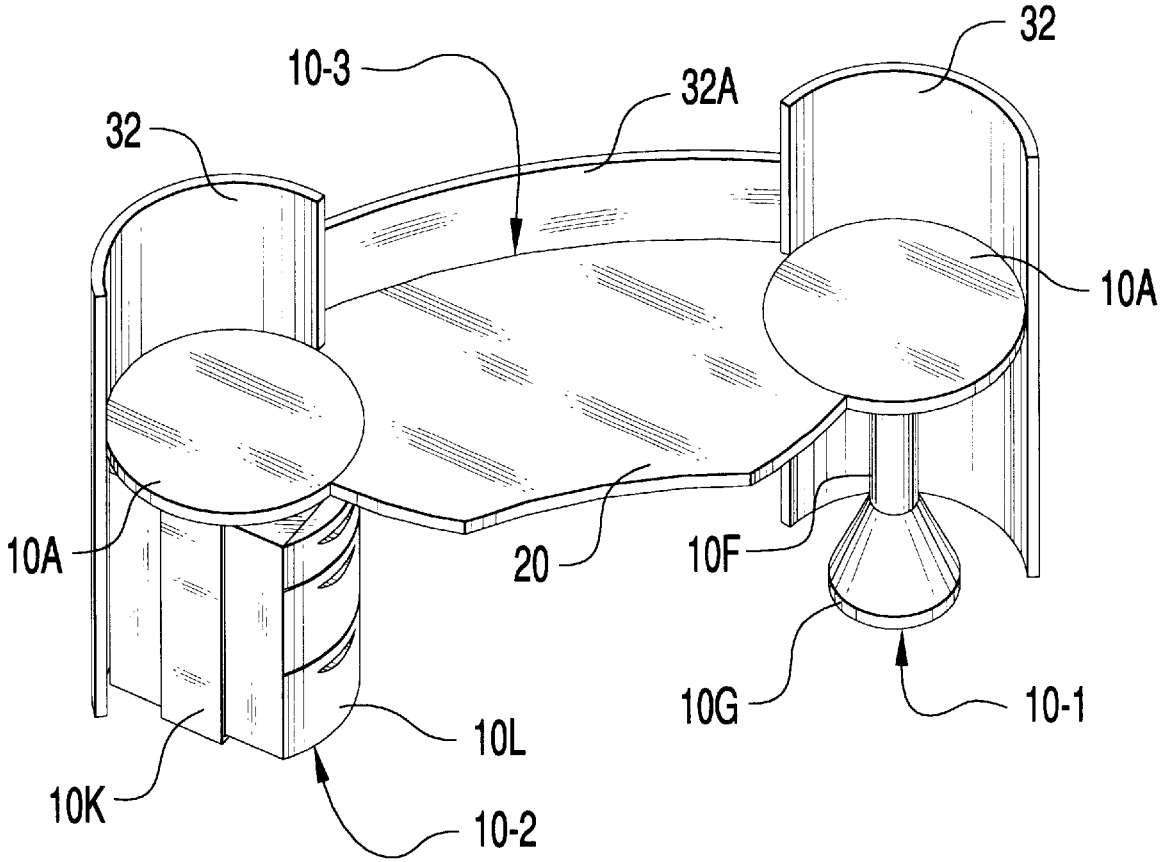
FIG. 1*c* shows a single furniture unit with partitions attached to it.
Figure 2A:
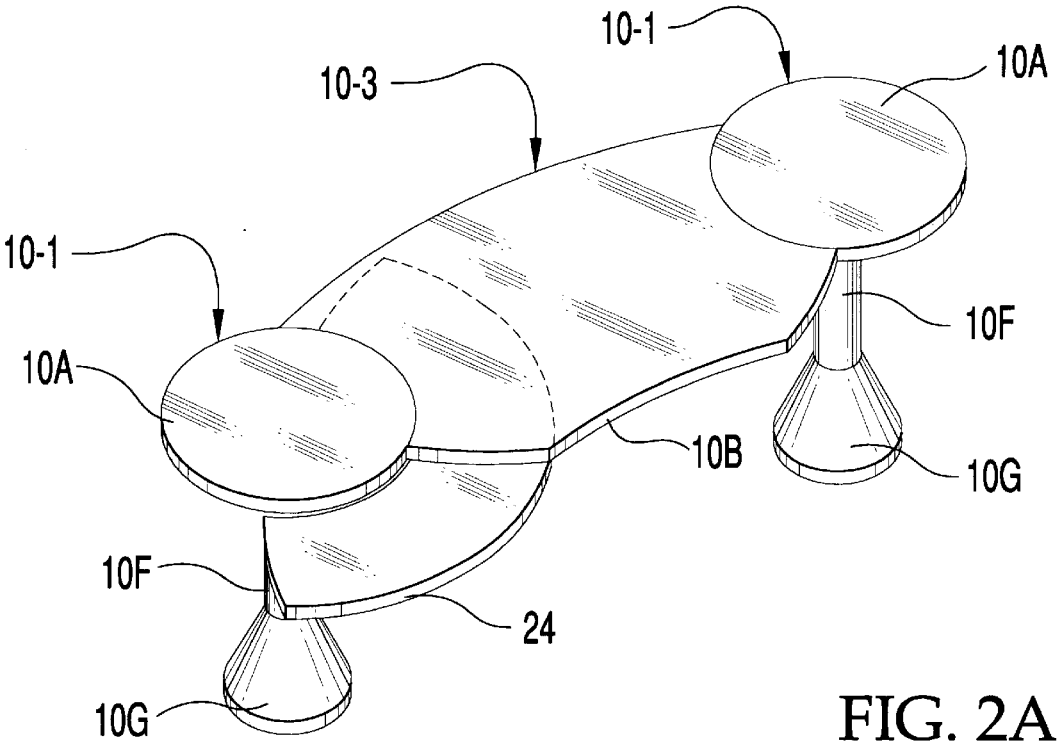
FIG. 2*a* shows a layout of a furniture unit standing by itself without any additional unit desks attached to it. Shown with two Basic Tower components.
Figure 2B:
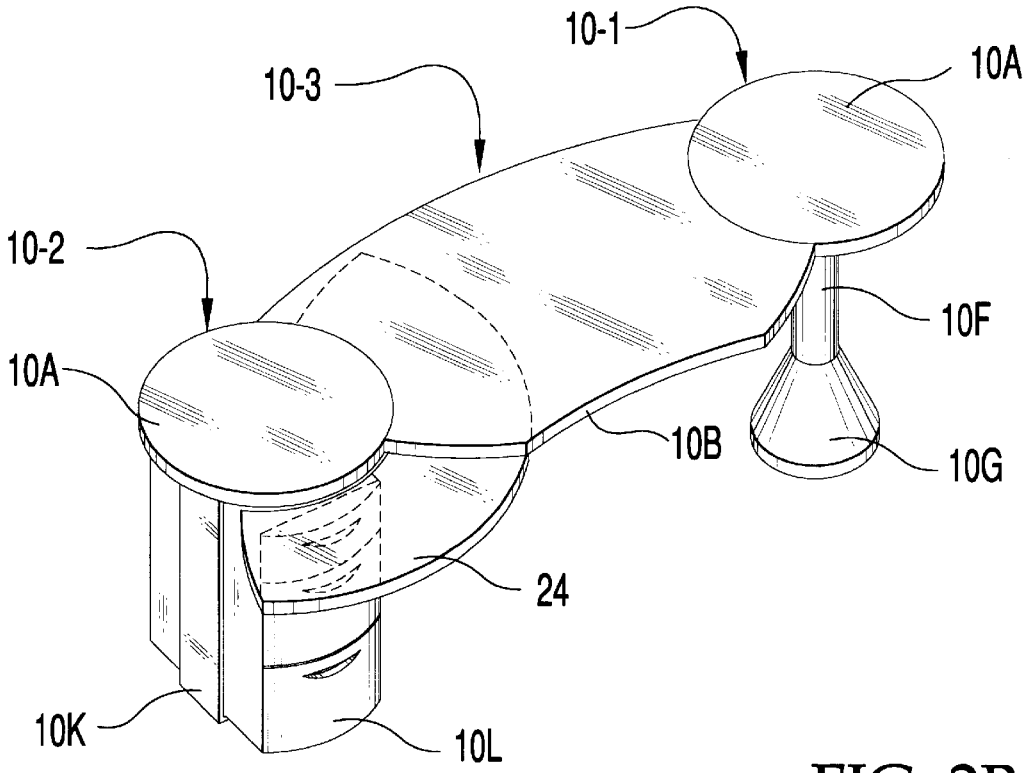
FIG. 2*b* shows a layout of a furniture unit standing by itself without any additional unit desks attached to it. Shown with a cage Tower component to its left.
Figure 3:
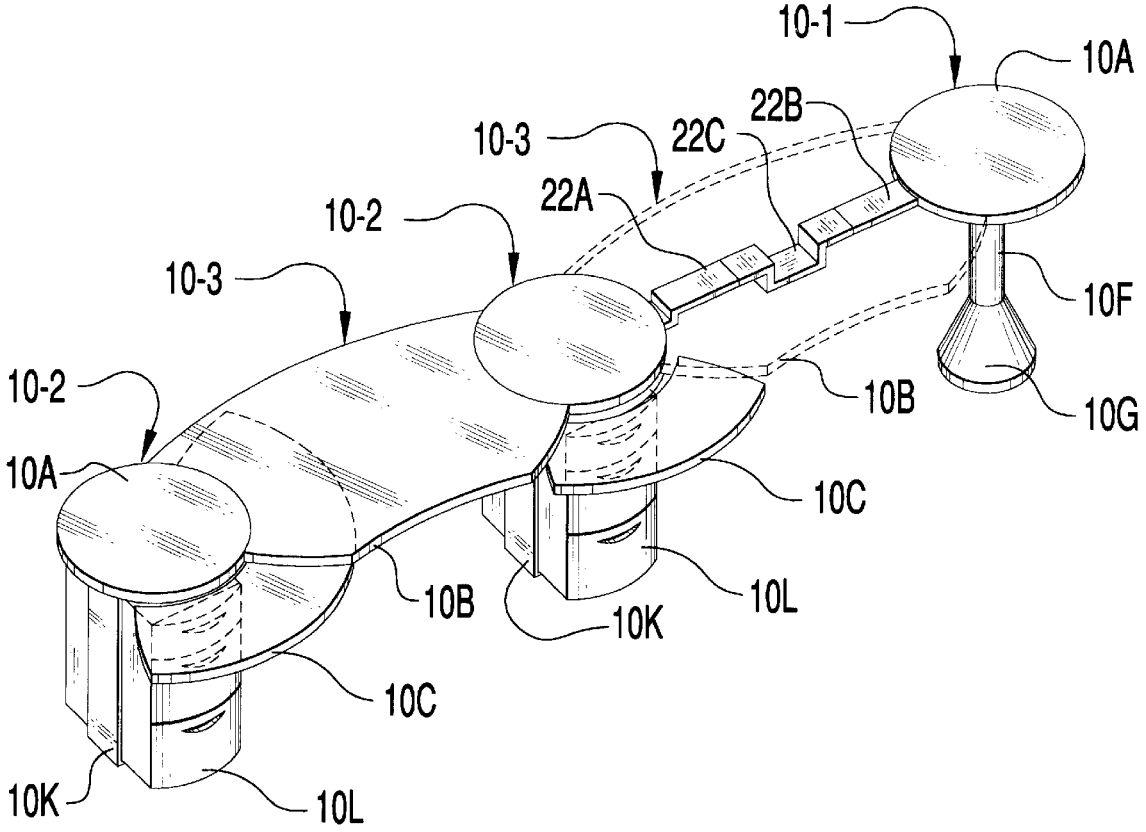
FIG. 3 shows a layout of two furniture units side-by-side and how each unit is capable of rotational freedom independent of each other.
Figure 4:
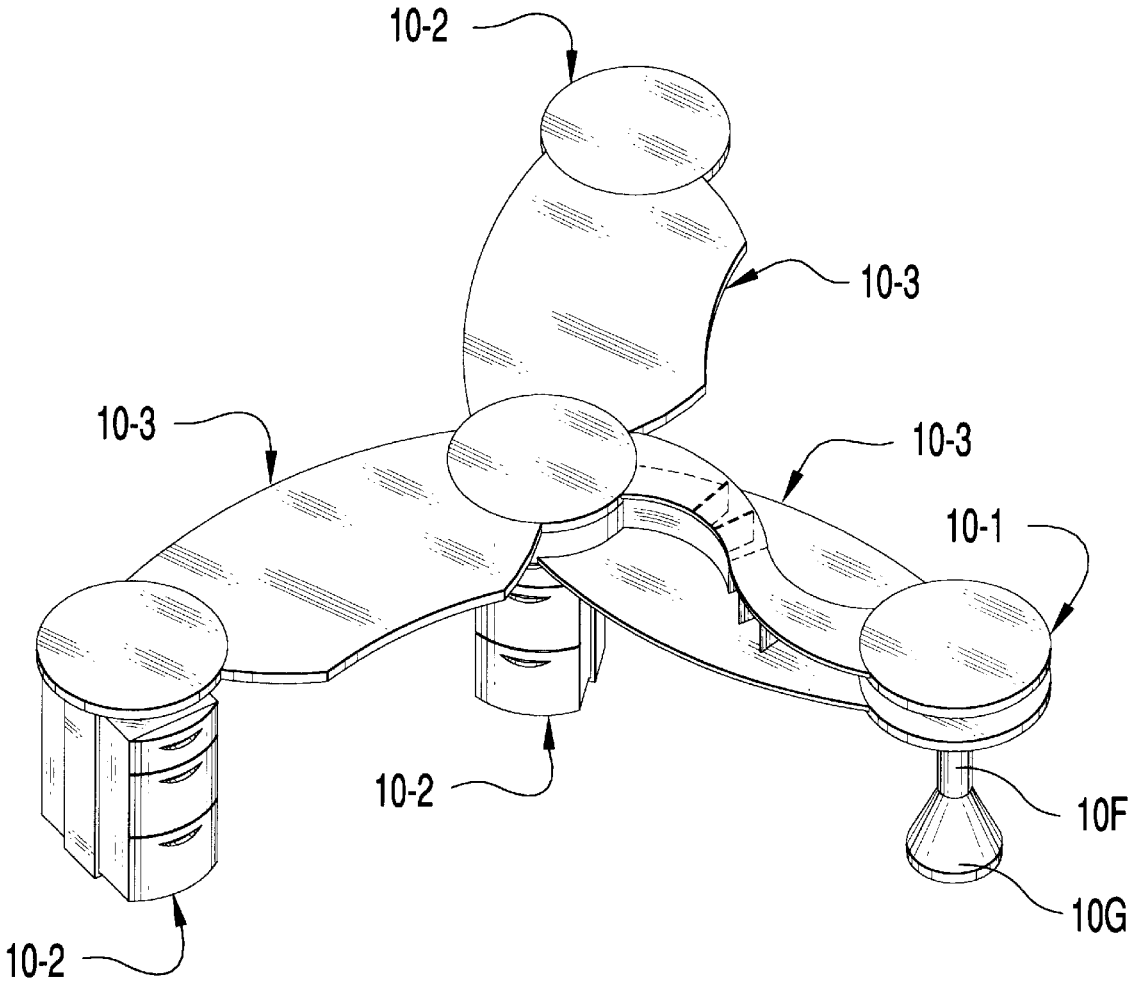
FIG. 4 shows how an additional desktop of any size may be placed as a divider between the two furniture units.
Figure 5A:
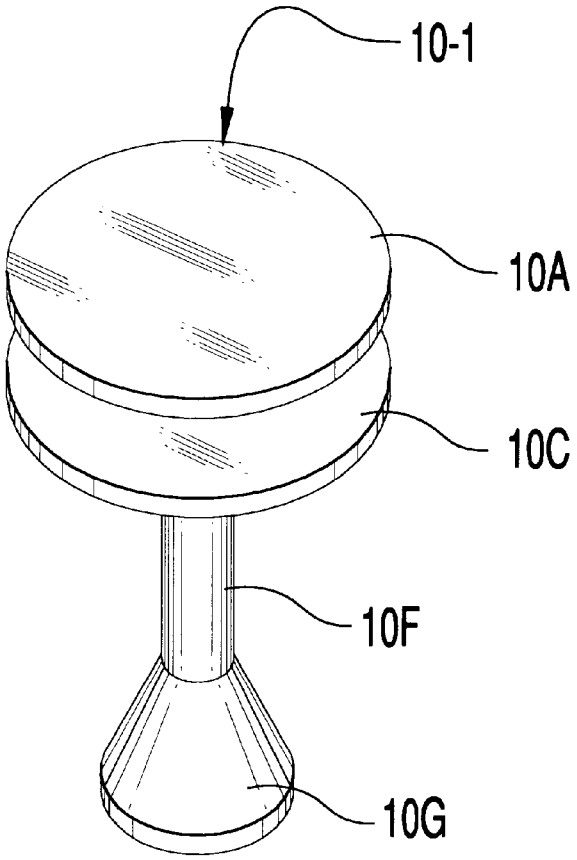
FIGS. 5*a–c* depict a close up view of the basic tower unit and its parts.
Figure 5B:
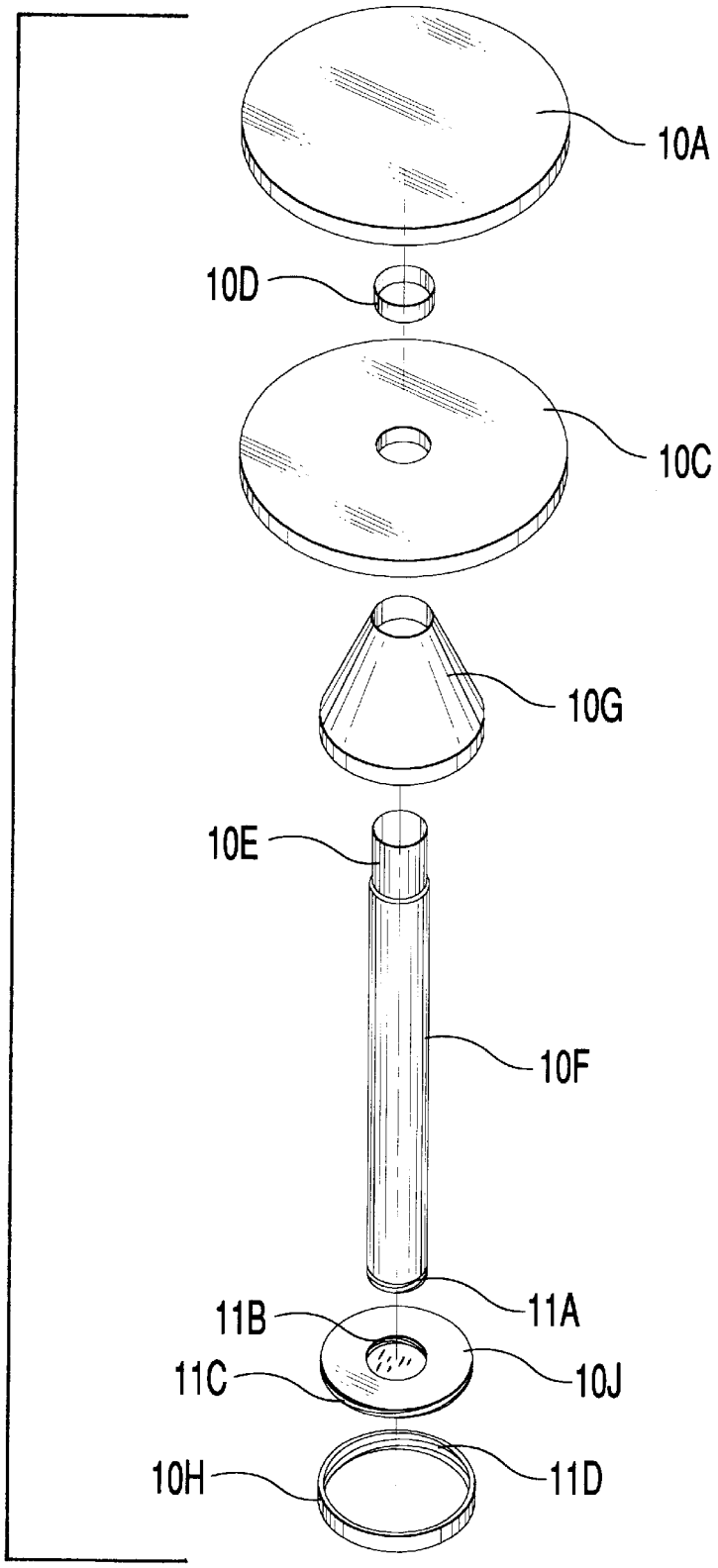
Figure 5C:
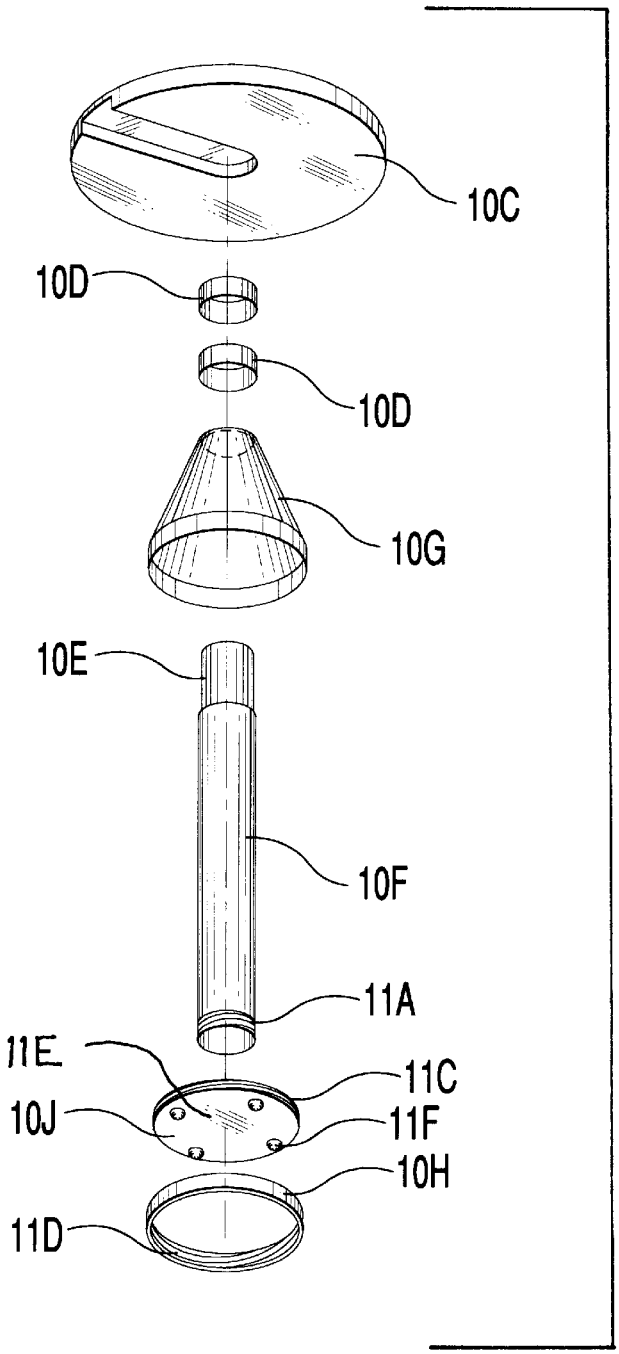
Figure 6A:
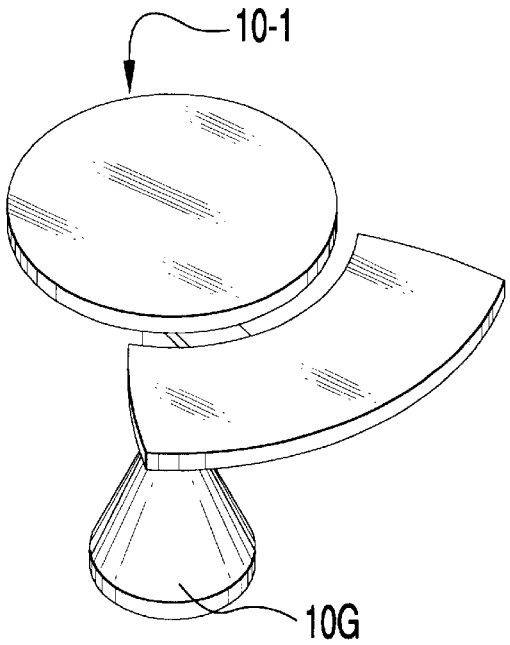
FIGS. 6*a–b* show a basic tower unit with an add-on shelf.
Figure 6B:
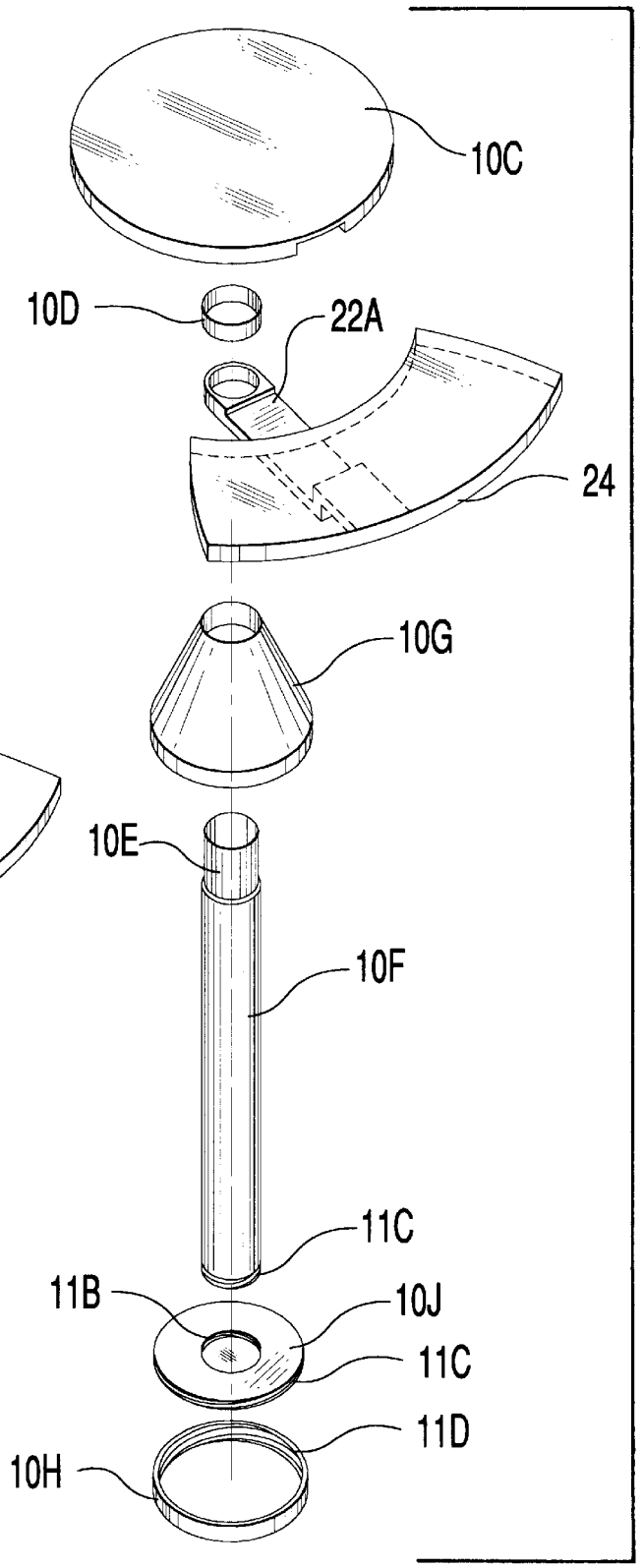
Figure 6C:
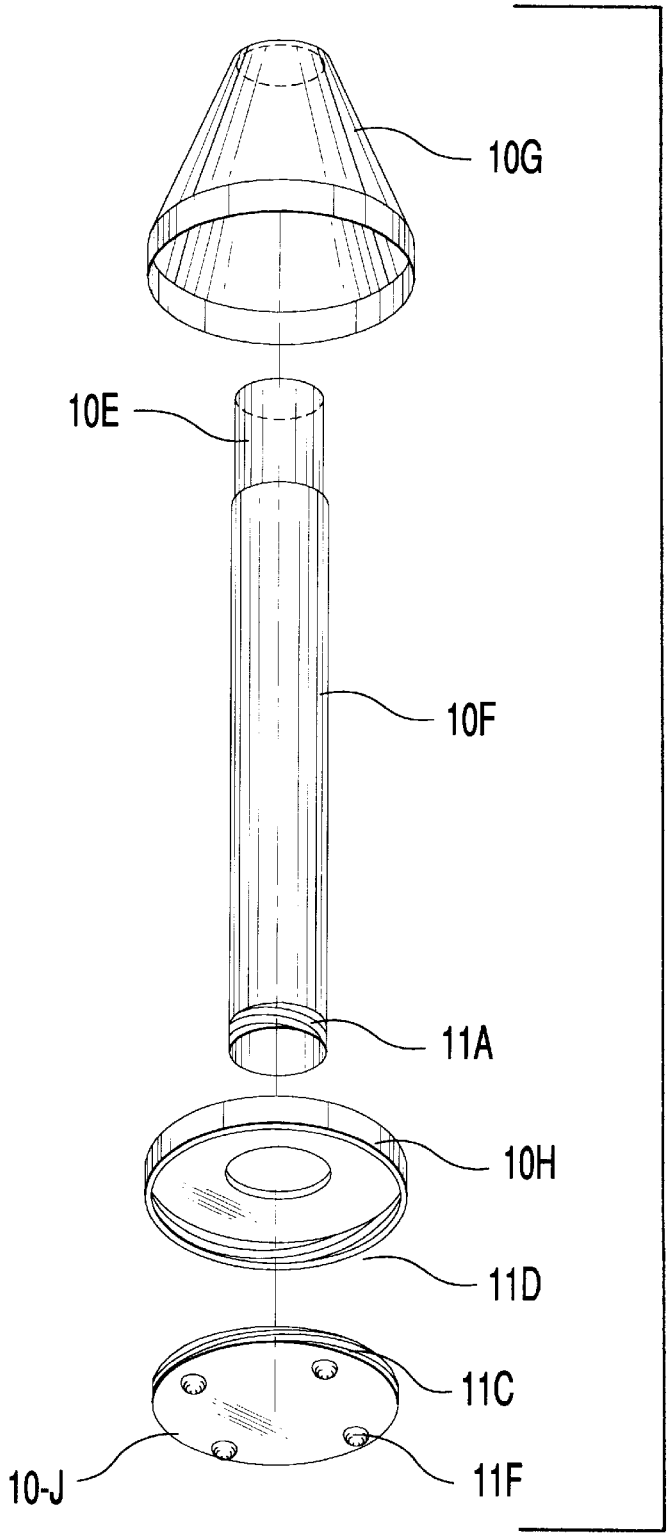
FIG. 6*c* is an enlarged view of the base of the basic tower unit.
Figure 6D:
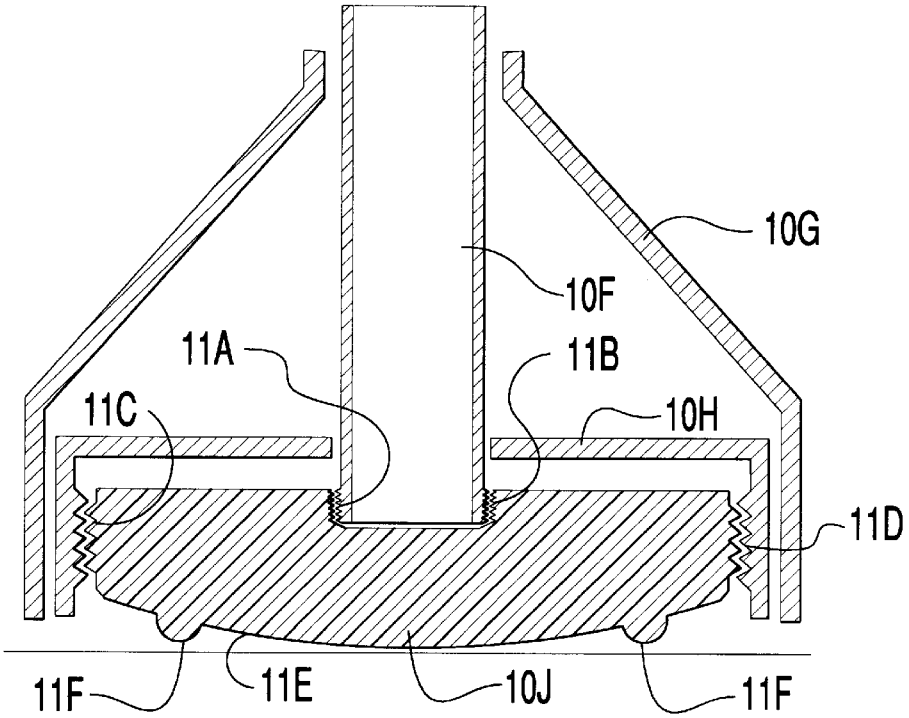
FIGS. 6*d* and 6*e* are cross-sectional views of the 2sliding base showing the locking ring retracted and extended, respectively.
Figure 6E:
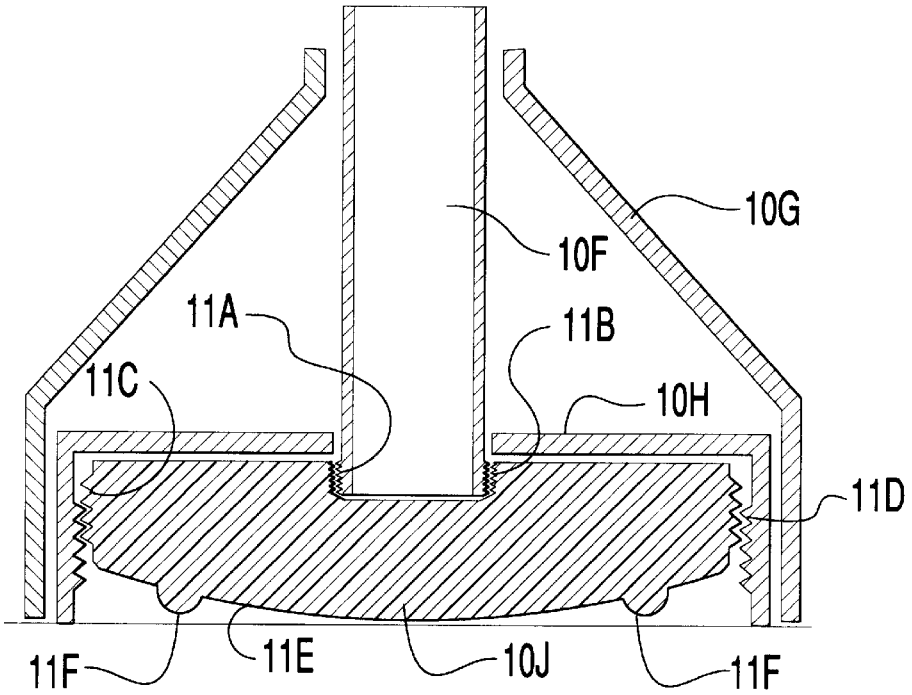
Figure 7A:
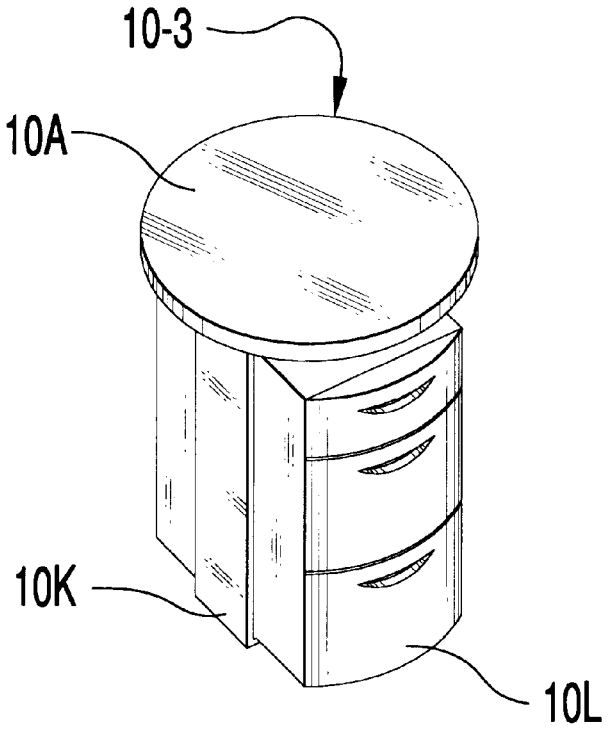
FIGS. 7*a–b* are close up views of the cage tower unit.
Figure 7B:
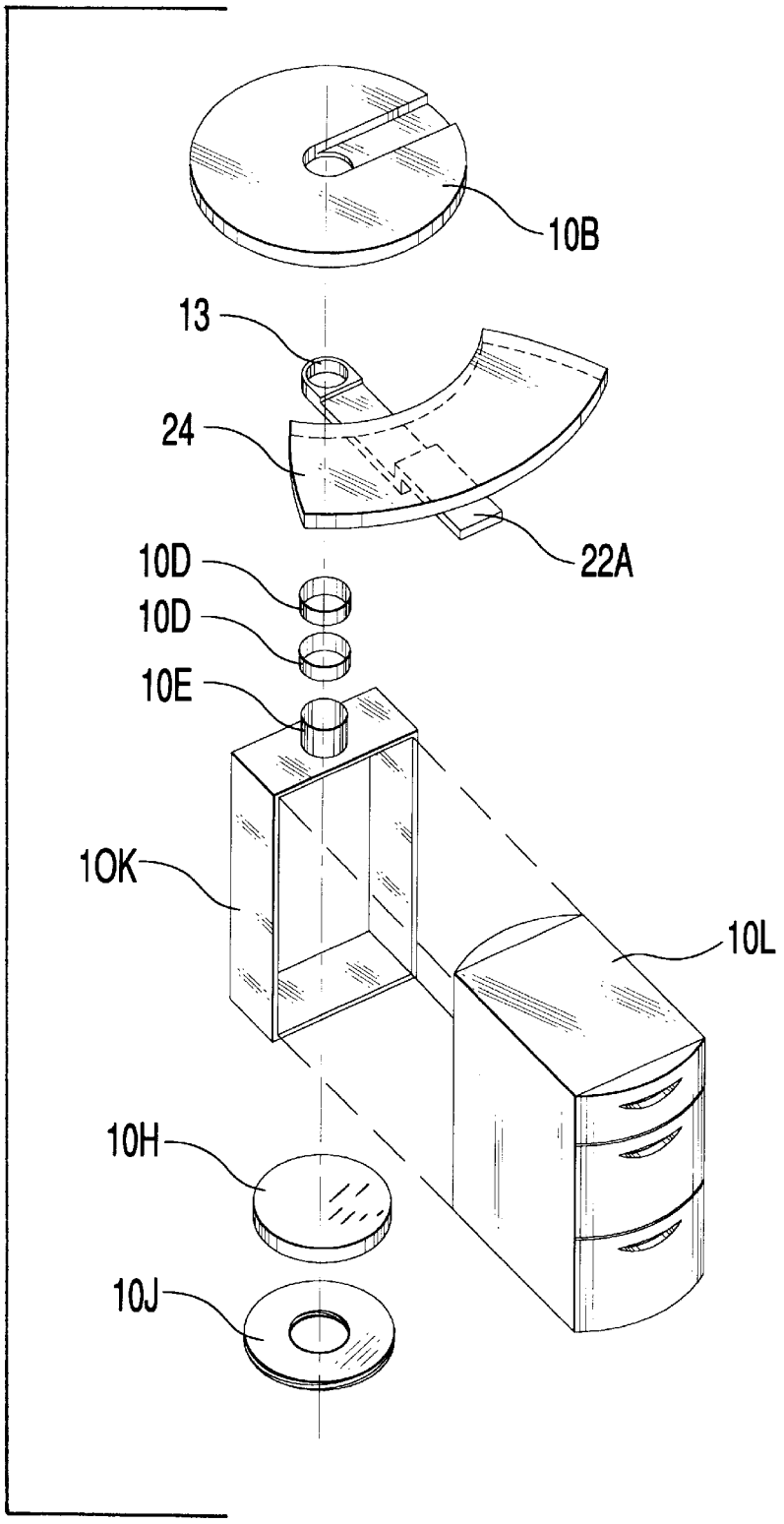
Figure 8:
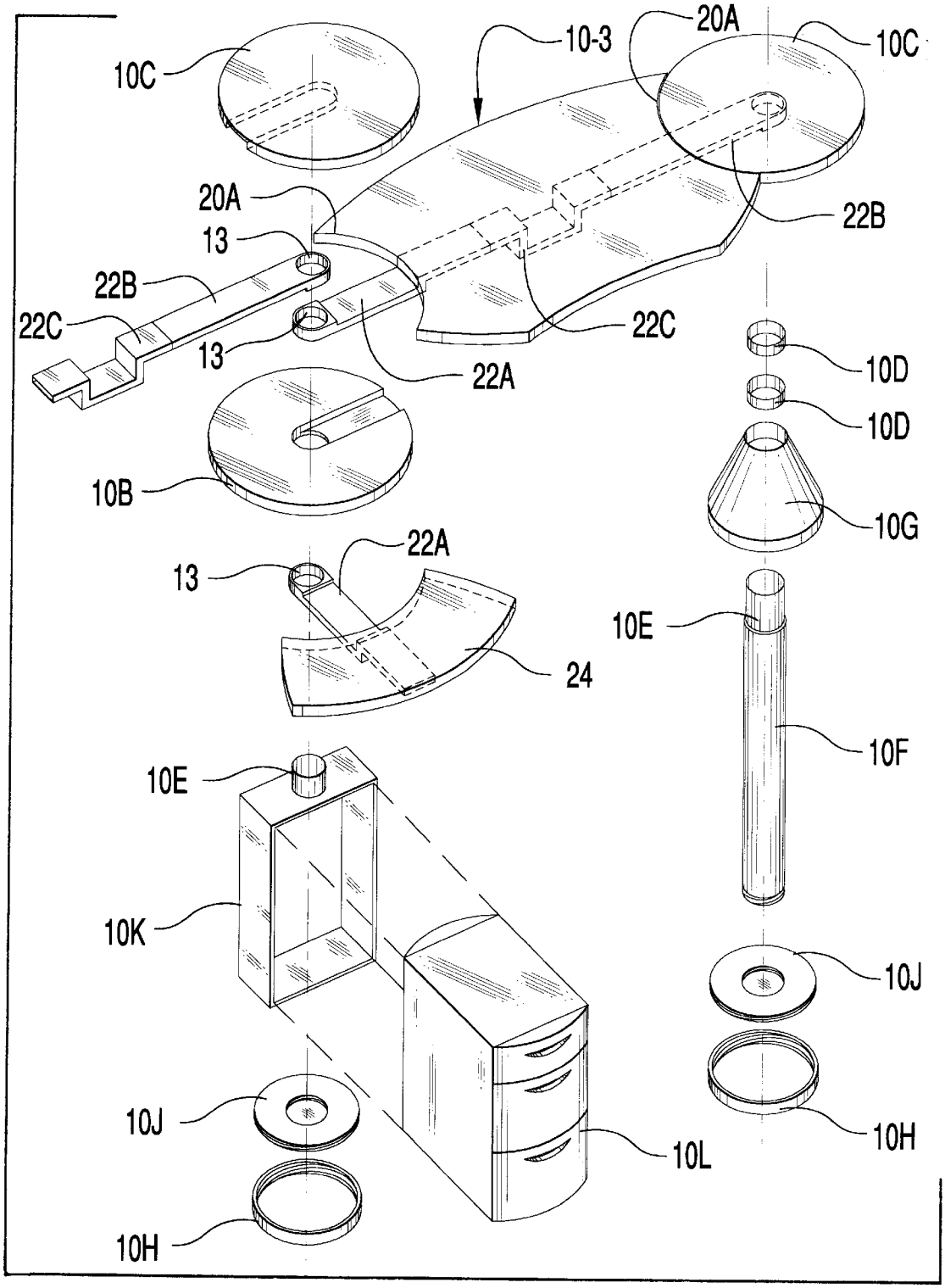
FIG. 8 shows an exploded view of the major components (but not limited to those components) that play a role in the system.
Figure 9:
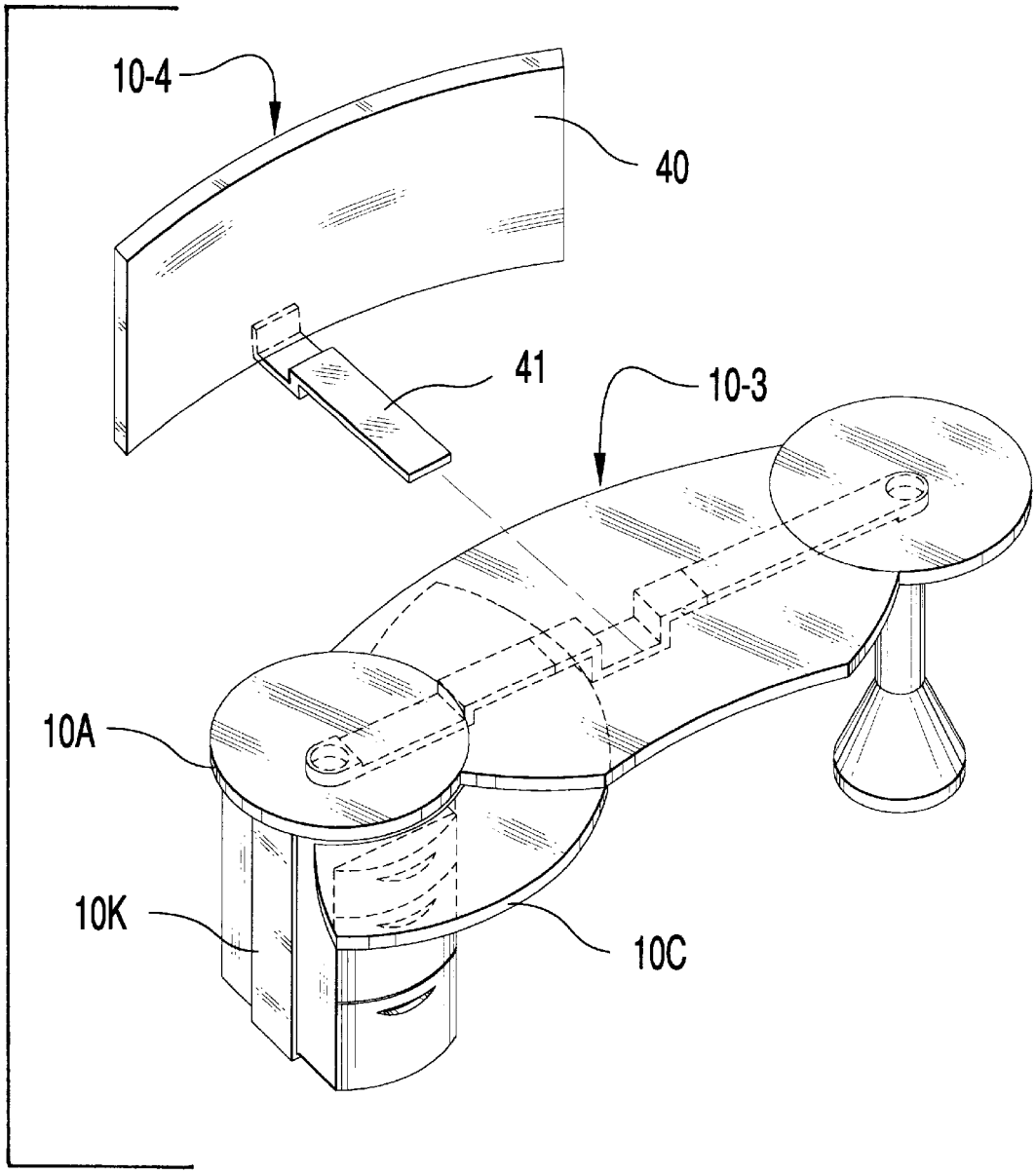
FIG. 9 shows a close up of how a partition is attached to a counter top midsection.

Cage tower 10-2 is shown in FIGS. 7*a*, 7*b* and 8 and is similar in concept to the basic tower 10-1, except the cage 10K replaces the central shaft 10F. Please note that the top and bottom of both 10F and 10K share similar details for attaching components, etc. The cage 10K allows attachments of large de-centralized components such as shelving, storage, file cabinets inserts 10L (shown), etc. The cage 10K and file cabinets 10L will be equipped with typical standard sliding apparatus and locking devices, allowing the file cabinet to slide into the cage to a locking position. The cage itself with its contents can be rotated along its axis. The file cabinet 10L can also be removed later and interchanged with another type of component increasing future flexibility. Similarly circular caps 10*a*–10*c* are mounted atop the cage tower. Examples of cage tower 10-2 in practical furniture arrangements can be seen in FIGS. 1*a*–4.

The next feature of our invention are the endless additions possible by removing one or two collar rings 10D from the shaft's neck 10E, by sliding 10D in an upward motion, and sliding on add-on arms 22A–22C, as can be seen in FIGS. 6*b*, 7*a*, 7*b* and 8. The add-on arms allow endless attachments such as a keyboard tray, a small shelf 24, a large countertop 10-3 (FIGS. 2*c* and 8) to be attached to neck 10E. Up to three add-ons are possible for each tower unit, including the cap. When in place, the add-on arms can be rotated 360° independently of each other. The donut-hole in the add-on arm opening shall have a bearing surface or sealed bearing 13. This would allow for a smooth operation.

It is the add-on arm that provides the ability to connect all of the three major components, (the two tower units and the midsection), to each other. It also allows each component to move independently since they are axially spaced from each other on neck 10E.

Figure 10:
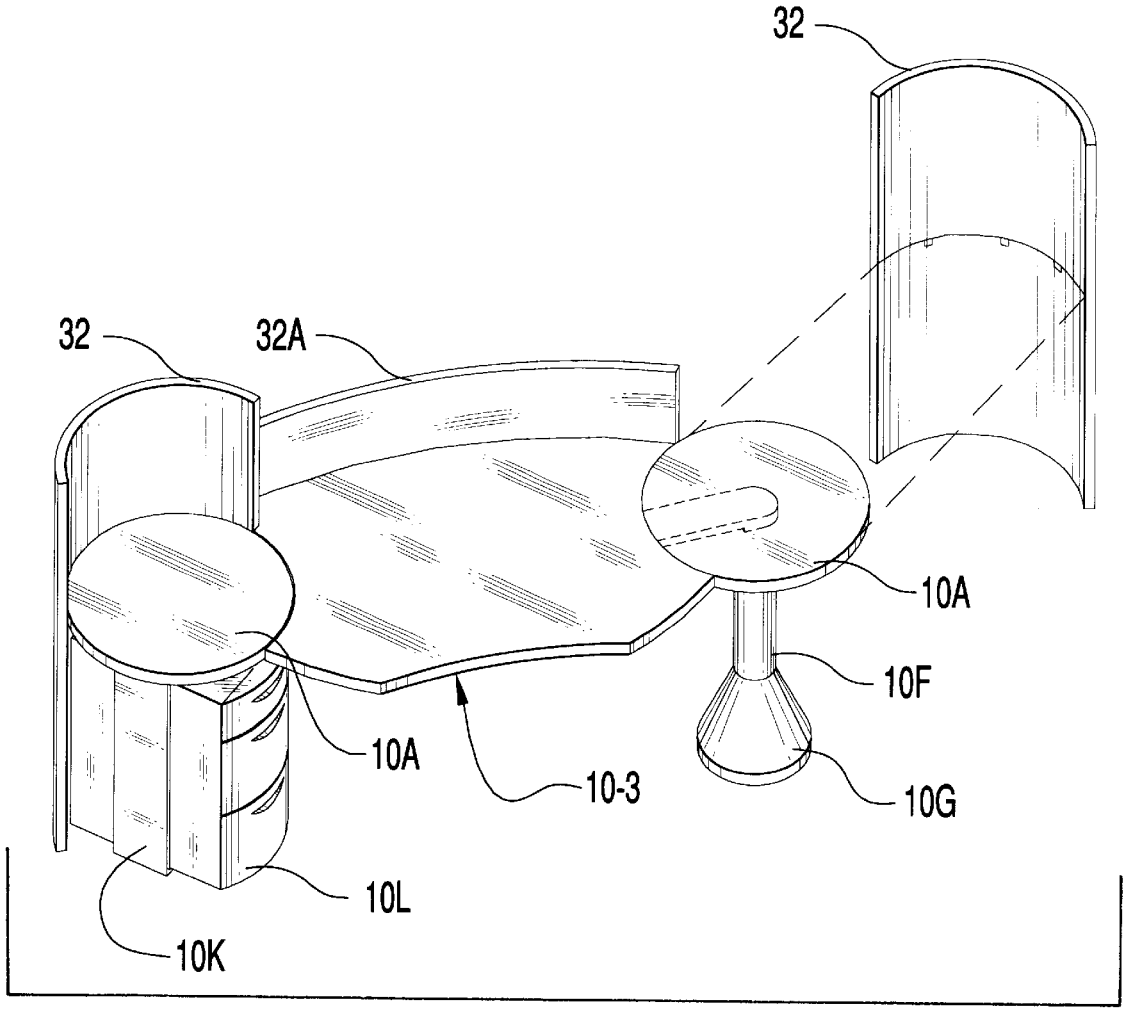
FIG. 10 shows a close up of a self-standing partition attached to a counter top midsection.

A counter top midsection 10-3 is a desktop which is contoured, i.e. circularly concave, at its ends 20A (FIG. 8) to allow for rotation between itself and the adjoining caps and tower units that it is attached to. Countertop midsection 10-3 is attached to a central bar 22C shown in FIG. 8 and disposed in the same plane as caps 10C. Central bar 22C includes a U-shaped depression to support a further arm for a monitor or a privacy panel shown in FIG. 9, which, in case of the monitor, may swivel from the center of the countertop midsection. Other partitions are shown in FIG. 10. Shelf 24 is axially spaced below cap 10C and countertop midsection 10-3 allowing it to pivot 360 degrees.

The furniture units of the invention operate together as a system as follows. The basic furniture unit comprises two tower units 10-1 and 10-2 and a counter top midsection 10-3. Connecting the mentioned components requires the add-on arm 22A–C. The tower unit contains a shaft where its neck 10E is used to provide a connection for the add-on arms. Each add-on arm has a ring opening 13 where it would slide onto the shaft's neck. This in turn allows for any components (ranging from shelf, keyboard shelf, drawer, second counter top, etc.) to be added by attaching to the add-on arm 22A–C. The add-on arms are able to rotate about the shaft's neck 10E. In turn, the shaft neck's 10E layering design provides room enough for additional add-on arms to be attached simultaneously and also rotate (or operate) independently of each other.

All components are attached in a similar manner. As shown on FIGS. 1*a*–*b*, using a pivotal connection between each and every component part and the tower unit's shaft, it is evident how flexible our furniture system is. Each component has the capability of detaching and re-attaching from one tower unit's shaft to another or detaching and re-attaching to an arm attached to the tower unit's shaft. For example, if we use the add-on arm 22A to attach a small shelf 24 and the placement of the shelf can be placed on either side of the user. It can be symmetrical with one on each side or it be relocated and replaced with a larger shelf.

Figure 11:
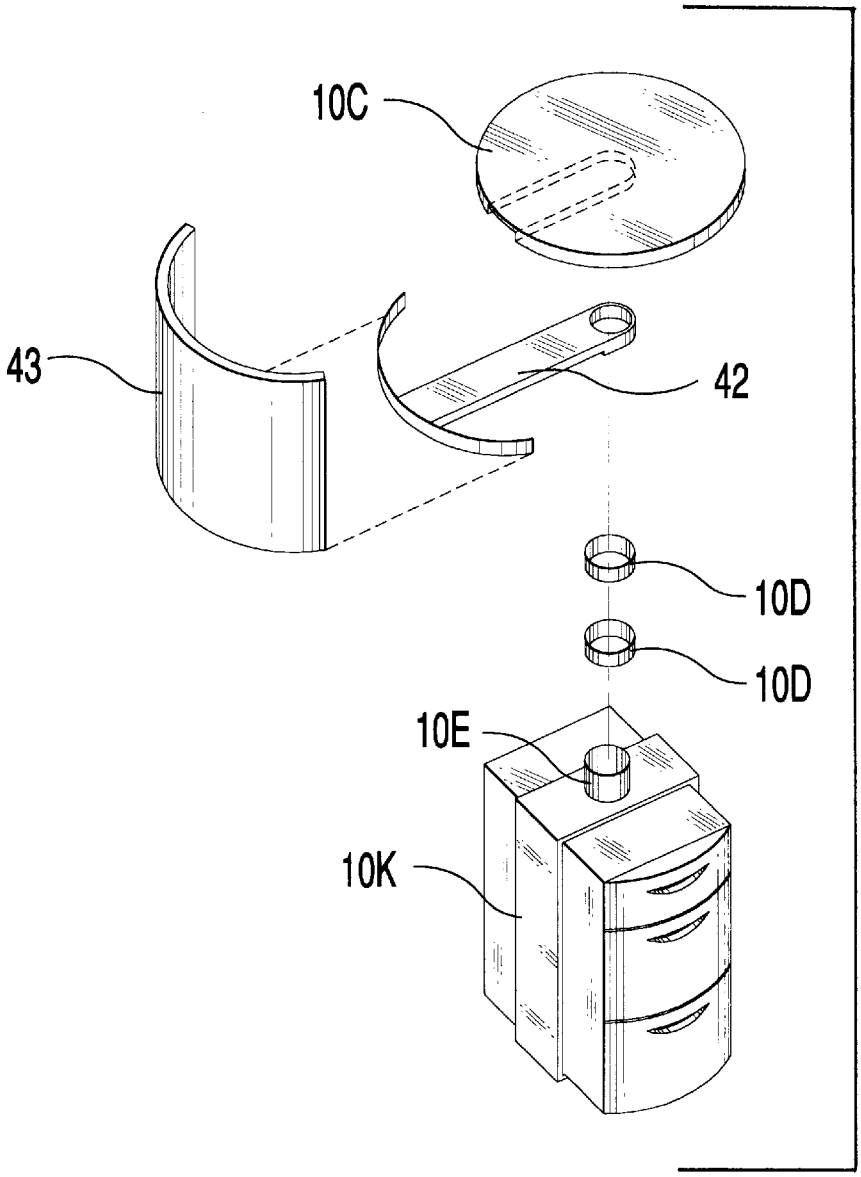
FIG. 11 shows how a curved partition may be attached to a tower unit via an arm bracket. Cage Tower is shown with this example.

Also notable in our invention is the ease of how each component can be independently designed to meet the user's needs. A furniture unit may be composed of a countertop midsection to provide a typical workstation for one person or two people. In other words, the midsection can be independently shaped in any form so as to provide room for one or more people. Multiple midsections can be joined together by adding additional tower units. Partitions can be added at any given time. FIG. 11 shows a partition 43 supported by an arm 42 which rotates about shaft 10E. Alternatively, partition 43 may be supported by the edge of countertop 10C. Flexible partitions can be attached to the system or stand independently. To have continuous partitions or to close all the gaps between the rigid screens, flexible partitions are used. They can be added on any place or can stand alone. During configuration changes, flexible partitions can change shape to accommodate the placement of any system configuration. The design possibilities are endless. Also, the finishes to be applied to these system are endless. All other components of our invention are equally successful in that manner.

In our invention, arrangements may also vary in quantity. Two tower units are the minimum necessary to provide the stability required for one furniture unit. The tower unit can also stand on its own if one chooses. Using four tower units, a user can develop a unique arrangement containing up to three furniture units. In plan the layout looks like a three-legged pinwheel. Later a fourth furniture unit may be added forming in plan a four-legged pinwheel. The furniture system also allows each furniture unit to be arranged in the same direction or facing each other, if the situation requires. As one can see, the possibilities for arrangements are endless and very versatile.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. A furniture assembly supporting one end of a desk top comprising:

a base having upper and lower portions and a central axis, a circular platform having a radius mounted to said base coaxial with said central axis, first means connected to said base for supporting the desk top beyond the platform radius, and a further furniture element and second means rotatable connected to said base and supporting said further furniture element for completely rotating said further furniture element about said base.

2. The assembly of claim 1, wherein said first supporting means includes first means for rotating the desk top about said axis.

3. The assembly of claim 2, wherein the desk top includes an end having a concave shape conforming to and abutting a portion of said circular platform.

4. The assembly of claim 1, wherein said platform is coplanar with the desk top.

5. The assembly of claim 1, wherein said second means is axially spaced from both said platform and said first supporting means.

6. The assembly of claim 5, wherein said upper portion includes an axle having a shoulder at a lower end thereof.

7. The assembly of claim 6, wherein each of said supporting means includes an annular collar for receiving said axle.

8. The assembly of claim 7, wherein said annular collars each include a bearing surface for contacting said axle.

9. The assembly of claim 8, wherein said annular collars are stacked on said axle, supported by said shoulder.

10. The assembly of claim 1, wherein said further furniture element is axially spaced from said platform.

11. The assembly of claim 1, wherein said further furniture element is axially spaced from the desk top.

12. The assembly of claim 1, wherein said lower portion of said base includes means adapted to provide low sliding friction with a floor surface.

13. The assembly of claim 12, wherein said low sliding friction means comprises a smooth spherical section having a large radius.

14. The assembly of claim 12, wherein said lower portion of said base further includes means adapted to selectively provide high sliding friction with the floor surface.

15. The assembly of claim 14, wherein said high sliding-friction means is disposed adjacent said low sliding-friction means.

16. The assembly of claim 15, further including means extending over and about said high and low sliding-friction means for covering said high and low sliding-friction means.

17. The assembly of claim 16, wherein said covering means is axially displaceable along said central axis above said high and low sliding-friction means.

18. The assembly of claim 1, wherein said base comprises means rotatable about said central axis, disposed between said upper and lower portions, for supporting a storage cabinet.

19. A furniture assembly supporting one end of a desk top comprising:

a base having upper and lower portions and a central axis, a circular platform having a radius mounted to said base coaxial with said central axis, first means connected to said base for rotatably supporting the desk top beyond the platform radius, and a further furniture element and second means connected to said base for supporting said further furniture element axially spaced from said desktop.

20. The assembly of claim 19, wherein said desk top is rotatable supported about said axis.

21. The assembly of claim 20, wherein the desk top includes an end having a concave shape conforming to and abutting a portion of said circular platform.

22. The assembly of claim 19, wherein said platform is coplanar with the desk top.

23. The assembly of claim 19, wherein said second means is axially spaced from both said platform and said first supporting means.

24. The assembly of claim 19, wherein said further furniture element is axially spaced from said platform.

25. A furniture assembly supporting one end of a desk top comprising:

a base having upper and lower portions and a central axis, a circular platform having a radius mounted to said base coaxial with said central axis, first means connected to said base for rotatably supporting the desk top beyond the platform radius, and a further furniture element and second means connected to said base for supporting said further furniture element axially spaced from said circular platform.

26. The assembly of claim 25, wherein said desk top is rotatably supported about said axis.

27. The assembly of claim 26, wherein the desk top includes an end having a concave shape conforming to and abutting a portion of said circular platform.

28. The assembly of claim 25, wherein said platform is coplanar with the desk top.

29. The assembly of claim 25, wherein said second means is axially spaced from both said platform and said first supporting means.

30. The assembly of claim 25, wherein said further furniture element is axially spaced from the desktop.

* * * * *

UNITED STATES PATENT AND TRADEMARK OFFICE

CERTIFICATE OF CORRECTION

PATENT NO. : 5,943,966

DATED : August 31, 1999

INVENTOR(S) : Jaime U. Machado and Mikhail L. Marsky

It is certified that error appears in the above-indentified patent and that said Letters Patent is hereby corrected as shown below:

Claim 1, col. 7, line 3, change "rotatable" to --rotatably--

Claim 12, col. 7, lines 32/33, change "sliding friction" to --sliding-friction--

Claim 13, col. 7, lines 34/35, change "sliding friction" to --sliding-friction--

Claim 14, col. 7, line 39, change "sliding friction to --sliding-friction--

Claim 20, col. 8, line 12, change "rotatable" to --rotatably--

Signed and Sealed this

Twenty-fifth Day of April, 2000

*Attest:*

Q. TODD DICKINSON

*Attesting Officer*

*Director of Patents and Trademarks*